US007467427B1

(12) United States Patent
Wu et al.

(10) Patent No.: US 7,467,427 B1
(45) Date of Patent: Dec. 23, 2008

(54) HANDRAIL MEANS OF BED FRAME

(75) Inventors: Chia-Sheng Wu, Taoyuan County (TW); Chien-Kuo Tsai, Taoyuan County (TW)

(73) Assignee: Optima Healthcare Inc., Taoyuan County (TW)

( * ) Notice: Subject to any disclaimer, the term of this patent is extended or adjusted under 35 U.S.C. 154(b) by 58 days.

(21) Appl. No.: 11/979,663

(22) Filed: Nov. 7, 2007

(30) Foreign Application Priority Data

Jul. 3, 2007 (TW) ..... 96210792 U

(51) Int. Cl.
*A47C 21/08* (2006.01)

(52) U.S. Cl. ..... 5/425; 5/428; 5/430

(58) Field of Classification Search ..... 5/425–430, 5/662

See application file for complete search history.

(56) References Cited

U.S. PATENT DOCUMENTS 6,725,476 B2 * 4/2004 Macari ..... 5/426
6,938,289 B2 * 9/2005 Morin ..... 5/425
6,959,463 B2 * 11/2005 Macari ..... 5/425
7,055,193 B2 * 6/2006 Macari et al. ..... 5/425
7,080,419 B2 * 7/2006 Macari ..... 5/426
7,150,053 B2 * 12/2006 Macari ..... 5/426
2004/0049849 A1 * 3/2004 Macari ..... 5/426
2004/0154100 A1 * 8/2004 Macari ..... 5/426
2005/0160527 A1 * 7/2005 Morin ..... 5/430
2005/0198734 A1 * 9/2005 Macari ..... 5/426
2005/0235419 A1 * 10/2005 Macari ..... 5/426
2005/0246837 A1 * 11/2005 Macari et al. ..... 5/426
2006/0090260 A1 * 5/2006 Stryker et al. ..... 5/430
2006/0130233 A1 * 6/2006 Macari et al. ..... 5/425

* cited by examiner

*Primary Examiner*—Robert G Santos
(74) *Attorney, Agent, or Firm*—Bacon & Thomas, PLLC

(57) ABSTRACT

A handrail means for a bed frame includes a handrail frame, a shield, a handrail fixing frame, and a swinging assembly. When the swinging assembly acts, the shield does not act yet so as to avoid from interfering with the swinging assembly. When the swinging assembly is oriented horizontally, the shield can be folded toward the inside of the handrail frame. When the swinging assembly achieves a predetermined point, the shield has completed its action. Therefore, during the action, the shield avoids the handrail means from contacting the ground, thereby smoothing the folding of the handrail means of the bed frame.

6 Claims, 5 Drawing Sheets

HANDRAIL MEANS OF BED FRAME

BACKGROUND OF THE INVENTION

1. Field of the Invention

The present invention relates to a handrail means of a bed frame, and in particular to a handrail means of a bed frame in which a safe shield is provided additionally in the handrail of the bed frame.

2. Description of Prior Art

In designing a bed frame, the most important thing of all is the safety of the user. Further, the safety and convenience in use are also important factors in design. The bed frame can be used not only in a sickbed of a hospital, but also an emergent bed frame on an ambulance. In addition, the coefficient of safety of the bed frame cannot be ignored because accidental carelessness will cause damage to the patient for the second time and even lead to death in serious cases. Therefore, in designing a bed frame, the comfort, safety and convenience in the operation of the user should be firstly taken into consideration. In order to prevent the user from turning his/her body over unconsciously and prevent an infant from falling out of the bed frame, the designer often provides handrails on both sides of the bed frame so as to avoid the possible danger.

Further, during the first aid process or when installing a life-support system, the handrail often obstructs the working of the medical personnel. Also, when the family member cares for the patient to turn over or clean his/her body, the handrail also obstructs the action of the family member. Therefore, a handrail lifting means for lifting or lowering the handrail is now provided on the bed frame, which is an important improvement in the fabrication thereof at the current stage. In order to smooth the movement of the handrail, the conventional handrail is designed to have a larger space for action, which makes the gap between the handrail and the bed frame too large and thus may cause a danger easily. Therefore, it is necessary to improve the drawbacks of prior art.

Therefore, in view of the drawbacks of the above-mentioned conventional art, the inventor proposes the present invention to overcome the above problems based on his expert experience and deliberate researches.

SUMMARY OF THE INVENTION

According to the above, in order to solve the drawbacks of prior art, the object of the present invention is to provide a handrail means of a bed frame, in which the gap between the handrail and the bed frame is reduced. Further, a shield is provided on the handrail so as to reduce the gap, thereby increasing the safety for the user.

Another object of the present invention is to provide a simple means for folding a handrail of a bed frame, thereby allowing the handrail of the bed frame to be folded smoothly.

In order to achieve the above objects, the present invention provides a handrail means for a bed frame, which comprises a handrail frame; a shield located below the handrail frame, both ends of the shield being pivotally connected onto the handrail frame, an upper end of the shield being provided with a gear set; a handrail fixing frame for helping the handrail to be fixed on the bed frame; a swinging assembly, upper and lower ends thereof being pivotally connected to the handrail frame and the handrail fixing frame respectively, the upper end thereof being provided with a bevel gear, the bevel gear being engaged vertically with a bevel gear of the gear set; and a locking element for locking the swinging assembly. The action of the swinging assembly causes the shield to be folded toward the inside of the handrail frame. When the swinging assembly achieves a predetermined point, the shield has completed its action. Therefore, during the action, the shield avoids the handrail frame from contacting the ground, thereby smoothing the folding of the handrail means of the bed frame.

Preferably, the handrail frame is formed by means of combining a frame body with a plurality of I-lettered rods.

Preferably, the gear is a bevel gear.

Preferably, a spur gear of the gear set is provided with spur teeth at the periphery thereof only in a range of 270 degrees, thereby controlling the action timing of the shield.

Preferably, the gear set comprises at least one bevel gear.

The above objects and functional features of the present invention will be described with reference to preferred embodiments thereof and the accompanying drawings.

DETAILED DESCRIPTION OF THE INVENTION

In order to further understand the other advantages, objects, technical characteristics and effects of the present invention, a detailed description of a preferred embodiment of the present invention will be made with reference to the accompanying drawings.

Figure 1:
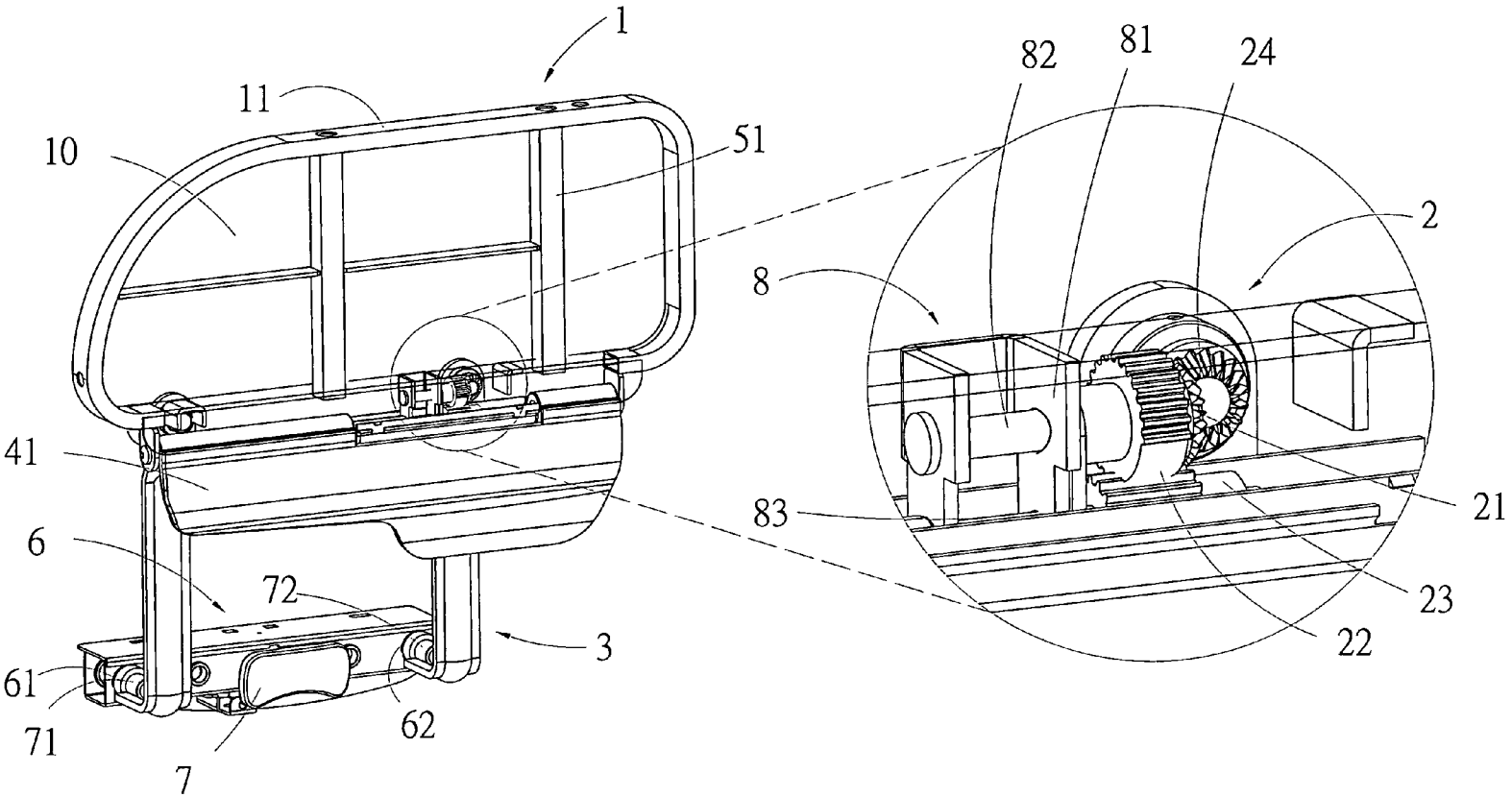
FIG. 1 is a schematic view showing the structure of a preferred embodiment of the present invention.

With reference to FIG. 1, the present invention provides a handrail means of a bed frame, which at least comprises a handrail frame 10 (constituted of a frame body 11 and a plurality of I-lettered rods 51), a gear set 2, a swinging assembly 3, a shield 41 and a locking element 7. Both ends of the shield 41 are pivotally connected to the handrail frame 10. An upper end of the shield has a hollow portion in which a gear fixing assembly 8 is provided. The gear fixing assembly 8 includes a gear fixing shaft 82, a gear fixing frame 81, a fixing frame positioning shaft 83, and the gear set 2. The gear set 2 is constituted of three gears, including a bevel gear 21 at a front end and a spur gear 22 at a rear end. The gear 22 at the rear end is provided with spur teeth on the periphery thereof only in the range of 270 degrees. A lower spur gear 23 is tangentially engaged with the spur gear 22. The upper end lower ends of the gear fixing frame 81 are each provided with two holes. Those holes are arranged in pairs and parallel to each other. The gear fixing frame 81 allows the fixing frame positioning shaft 83 to penetrate through the two holes of the lower end of the gear fixing frame 81, thereby positioning the gear fixing frame 81. After the gear fixing shaft 82 penetrates the two holes of the upper end of the gear fixing frame 81, the gear fixing shaft is positioned and combined with the gear set 2 comprising the bevel gear and the spur gear. The spur gear 23 is positioned and combined with the front end of the fixing frame positioning shaft 83. The inside of the frame body 11 is provided with a plurality of recessed holes. A portion of the recessed hole is combined with the I-lettered beam 51. The lower end of the inside of the frame body 11 is provided with a circular recessed hole that is combined with the bevel gear 24 of the upper end of the swinging assembly 3. The bevel gear 24 is engaged with a bevel gear of the gear set 2 vertically. The front and back surfaces of the handrail fixing frame 6 are provided with a plurality of holes. The holes 61, 62 are combined with the front ends of sleeves 71, 72, respectively. The rear ends of the sleeves 71, 72 are combined with the lower end of the swinging assembly. The locking element 7 is used to lock the action of the swinging assembly 3.

Figure 2:
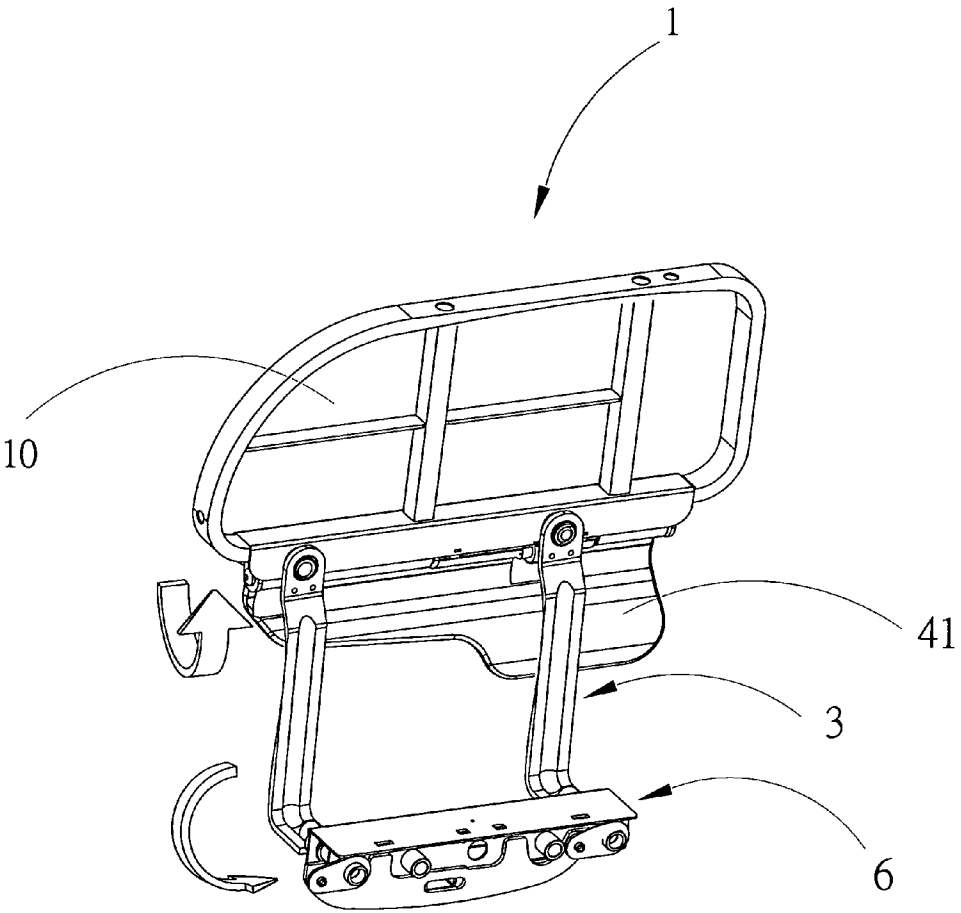
FIG. 2 is a schematic view (I) showing the action of the preferred embodiment of the present invention.
Figure 3:
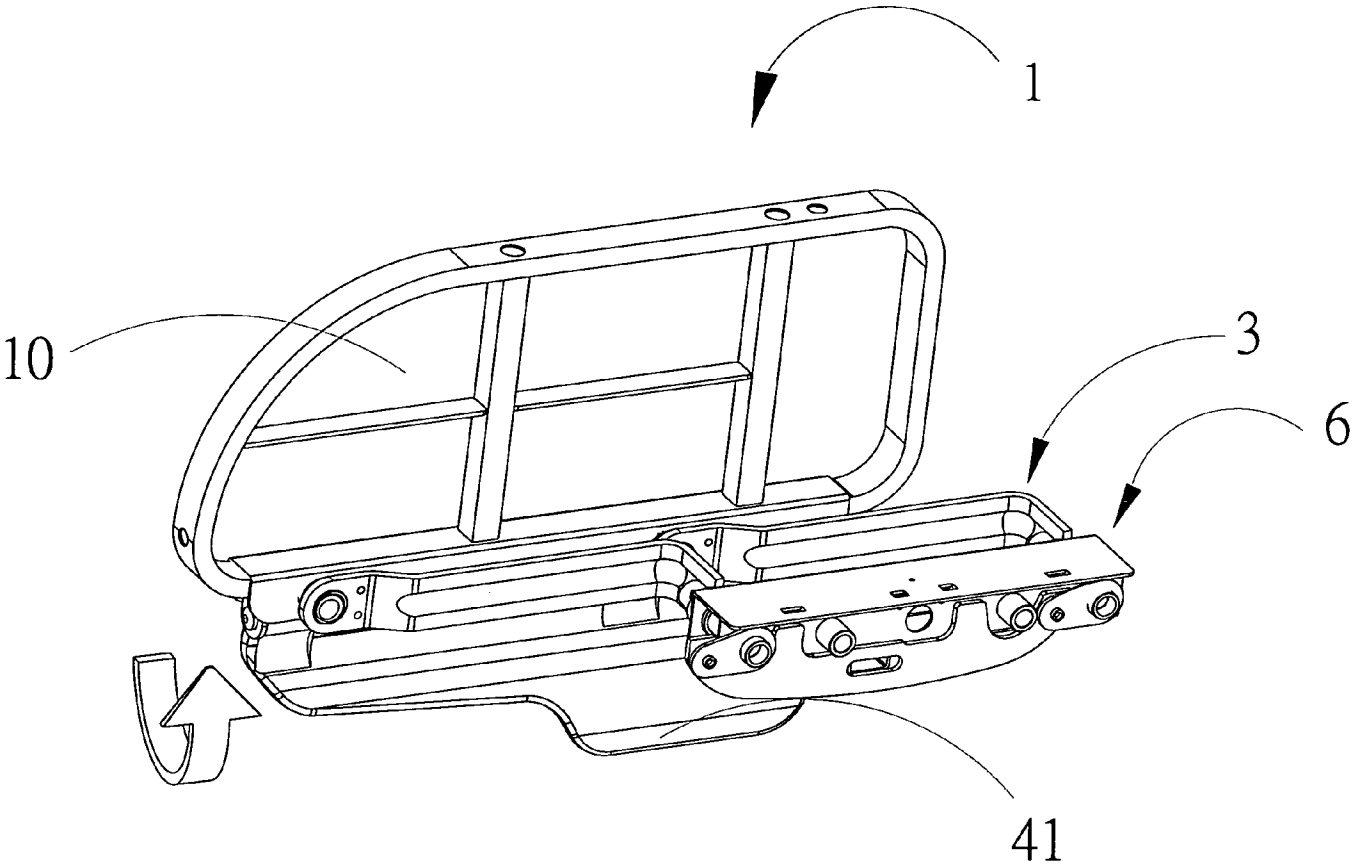
FIG. 3 is a schematic view (II) showing the action of the preferred embodiment of the present invention.
Figure 4:
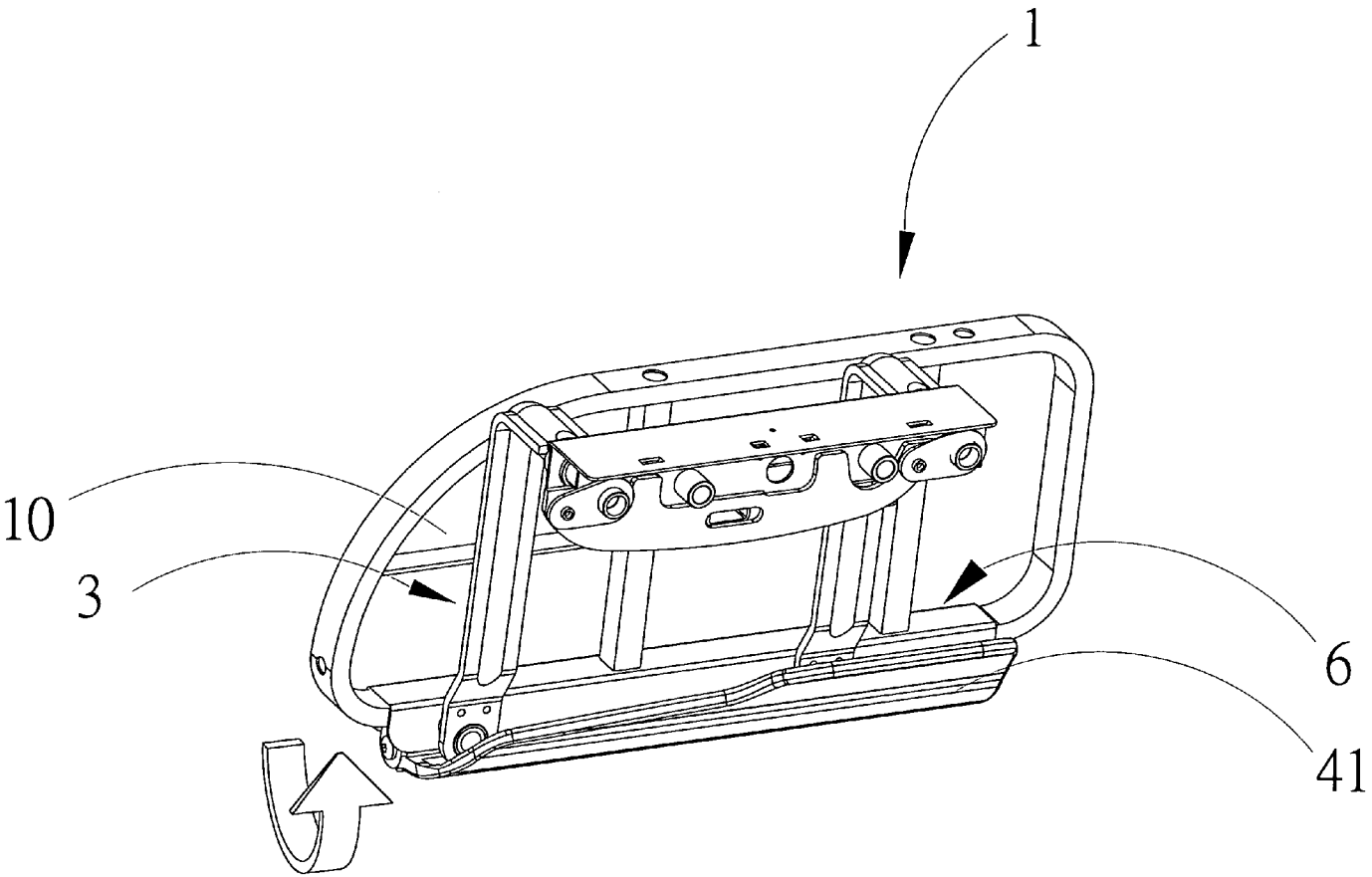
FIG. 4 is a schematic view (III) showing the action of the preferred embodiment of the present invention.

With reference to FIGS. 2 to 4, when a user intends to put down the handrail of the bed frame, he/she pulls the locking element 7. At this time, the swinging assembly 3 is controlled to start swinging. The bevel gear 24 provided on the upper end of the swinging assembly 3 rotates to drive the bevel gear 21 on the front end of the gear set 2 in the hollow portion of the upper end of the shield 41. Since the gear 22 on the rear end is provided with spur teeth only in the range of 270 degrees for being tangentially engaged with the spur gear 23, and the spur gear 22 on the rear end is not provided with teeth in the first 90 degrees so as to become an idle stroke, when the bevel gear 21 on the front end drives the rotation of the spur gear 22 on the rear end, the spur gear 22 on the rear end does not contact the associated tangential spur gear 23 during the first 90 degrees of idle stroke. Such a design aims to avoid the shield 2 from interfering with the swinging assembly 3 because the shield 41 cannot act without the rotation of the spur gear 23. When the first 90 degrees of idle stroke of the spur gear 22 is ended, after the spur teeth provided on the spur gear 22 is tangentially engaged with the spur gear 23, the spur gear 23 starts to rotate and drives the lower end of the shield to be folded toward the inside of the handrail frame 10. When the swinging assembly 3 reaches a horizontal orientation as shown in FIG. 3, after the 270-degree spur teeth provided on the spur gear 22 are disengaged from the tangentially engaged portion of the spur gear 23, the shield 41 stops its action and is folded into the handrail means 1 of the bed frame. In this way, the height of the handrail means 1 of the bed frame can be avoided from being too large so as to contact the ground. At this time, the swinging assembly 3 continues to generate a displacement. When the swinging assembly 3 moves to the position exactly below the original point (as shown in FIG. 4), the action is completed and the handrail means 1 of the bed frame can be folded smoothly. During the return of the handrail means 1 of the bed frame to the original state, no interference in action may occur due to the design of an idle stroke in this handrail means.

Figure 5:
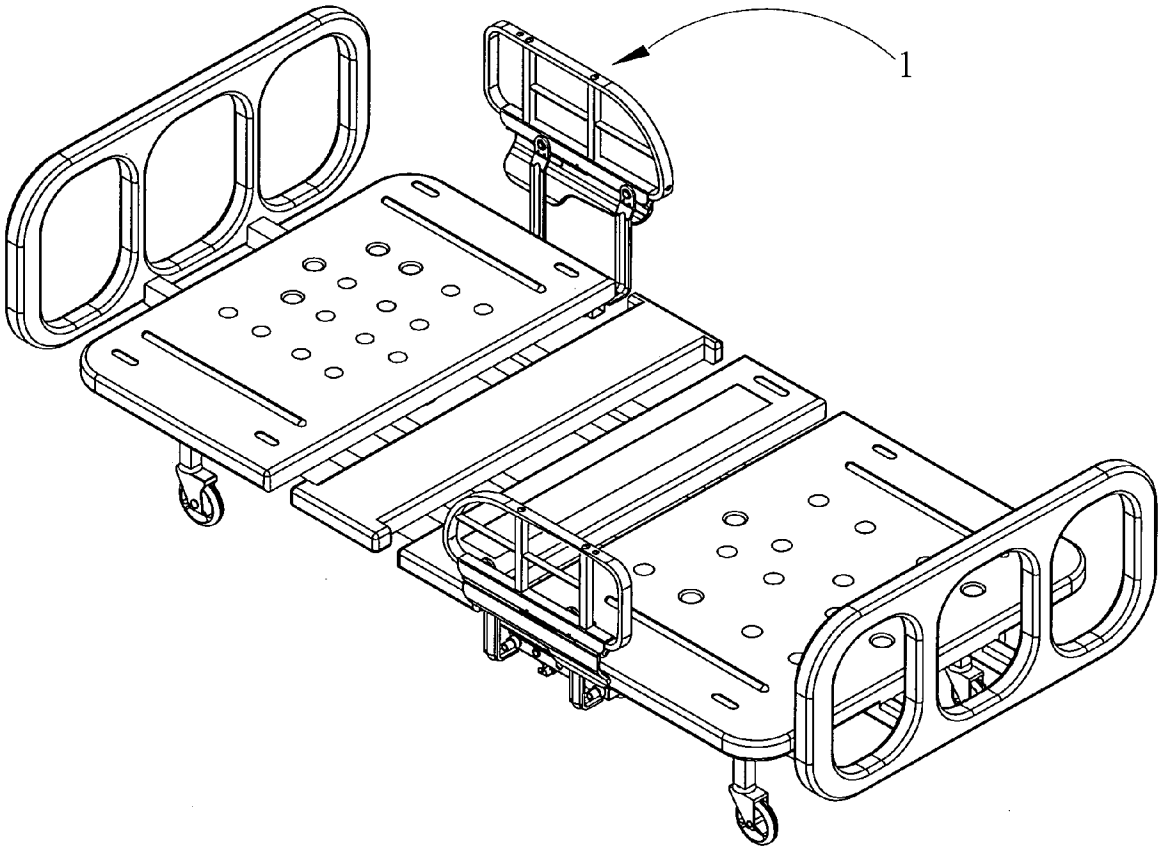
FIG. 5 is a schematic view showing the arrangement of the preferred embodiment of the present invention.

With reference to FIG. 5, it shows an embodiment of the handrail means of the bed frame of the present invention which is arranged at corresponding positions on both sides of the bed frame.

Although the present invention has been described with reference to the foregoing preferred embodiment, it will be understood that the invention is not limited to the details thereof. Various equivalent variations and modifications with regard to the construction or arrangement thereof can still occur to those skilled in this art in view of the teachings of the present invention. Thus, all such variations and equivalent modifications are also embraced within the scope of the invention as defined in the appended claims.

According to the above, the present invention has not been published or used in public, and thus really has novelty and inventive steps. Therefore, the present invention conforms to the requirements for a utility model patent.

What is claimed is:

1. A handrail means of a bed frame, comprising:

a handrail frame;

a shield located below the handrail frame, both ends of the shield pivotally connected onto the handrail frame, an upper end of the shield being provided with a gear set;

a handrail fixing frame fixed on the bed frame;

a swinging assembly, upper and lower ends thereof being pivotally connected with the handrail frame and the handrail fixing frame respectively, the upper end of the swinging assembly being provided with a gear, the gear being engaged with a bevel gear of the gear set vertically;

a locking element for locking the swinging assembly;

characterized in that:

the action of the swinging assembly drives the shield to be folded toward the inside of the handrail frame, the shield completes its action when the swinging assembly has reached a predetermined point, the handrail means of the bed frame is avoided from contacting the ground during the action thereof, thereby allowing the handrail means of the bed frame to be folded smoothly.

2. The handrail means of a bed frame according to claim 1, wherein the handrail frame is constituted of a frame body and a plurality of I-lettered rods.

3. The handrail means of a bed frame according to claim 1, wherein the gear is a bevel gear.

4. The handrail means of a bed frame according to claim 1, wherein the gear set at least comprises a bevel gear.

5. The handrail means of a bed frame according to claim 1, wherein the gear set at least comprises a spur gear, only a part of the periphery of the spur gear is provided with spur teeth for being engaged with a spur gear to generate an intermittent associated action, thereby controlling the action timing of the shield.

6. The handrail means of a bed frame according to claim 5, wherein the first part of the action of putting down and folding the handrail means of the bed frame is an idle stroke without driving the shield, the shield only acts in a middle stroke of the whole action of the handrail means of the bed frame, thereby avoiding the interference.

* * * * *